US012492863B2

(12) United States Patent
Golubev

(10) Patent No.: US 12,492,863 B2
(45) Date of Patent: Dec. 9, 2025

(54) PROCESS AND PLANT FOR LOW-TEMPERATURE SEPARATION OF AIR

(71) Applicant: Linde GmbH, Pullach (DE)

(72) Inventor: Dimitri Golubev, Geretsried (DE)

(73) Assignee: LINDE GMBH, Pullach (DE)

( * ) Notice: Subject to any disclaimer, the term of this patent is extended or adjusted under 35 U.S.C. 154(b) by 267 days.

(21) Appl. No.: 17/906,499

(22) PCT Filed: Mar. 5, 2021

(86) PCT No.: PCT/EP2021/025093
§ 371 (c)(1),
(2) Date: Sep. 16, 2022

(87) PCT Pub. No.: WO2021/190784
PCT Pub. Date: Sep. 30, 2021

(65) Prior Publication Data

US 2023/0038170 A1 Feb. 9, 2023

(30) Foreign Application Priority Data

Mar. 23, 2020 (EP) ..... 20020131

(51) Int. Cl.
*F25J 3/02* (2006.01)
*F25J 3/04* (2006.01)

(52) U.S. Cl.
CPC ..... *F25J 3/0423* (2013.01); *F25J 3/0409* (2013.01); *F25J 3/04212* (2013.01);
(Continued)

(58) Field of Classification Search
CPC .. F25J 2200/34; F25J 3/04436; F25J 3/04454; F25J 3/0423; F25J 3/0409;
(Continued)

(56) References Cited

U.S. PATENT DOCUMENTS 4,617,036 A * 10/1986 Suchdeo ..... F25J 3/04321 62/652
4,715,873 A 12/1987 Auvil et al.
(Continued)

FOREIGN PATENT DOCUMENTS

DE 10205096 A1 5/2003
DE 102009023900 A1 12/2010
(Continued)

*Primary Examiner* — Miguel A Diaz
*Assistant Examiner* — Esmeralda Arreguin-Martinez
(74) *Attorney, Agent, or Firm* — Millen, White, Zelano & Branigan, P.C.; Brion P. Heaney

(57) ABSTRACT

Described herein is a process for low-temperature separation of air, in which an air separation plant having a first rectification column and a second rectification column is used, the first rectification column being supplied with cooled compressed air and the second rectification column being supplied with liquid from the first rectification column or liquid formed herefrom. In a first condenser-evaporator, head gas from the first rectification column is condensed and liquid from the second rectification column, or liquid formed herefrom, is evaporated, thereby producing a first evaporation product.

19 Claims, 4 Drawing Sheets

(52) U.S. Cl.
CPC ..... *F25J 3/04321* (2013.01); *F25J 3/04454* (2013.01); *F25J 2200/54* (2013.01); *F25J 2200/94* (2013.01); *F25J 2235/42* (2013.01); *F25J 2245/42* (2013.01); *F25J 2250/02* (2013.01); *F25J 2250/20* (2013.01); *F25J 2270/02* (2013.01)

(58) Field of Classification Search
CPC .. F25J 3/04212; F25J 3/04321; F25J 2200/54; F25J 2200/94; F25J 2235/42; F25J 2245/42; F25J 2250/02; F25J 2250/20; F25J 2270/02; F25J 3/04412
See application file for complete search history.

(56) References Cited

U.S. PATENT DOCUMENTS

| | | | | |
|---|---|---|---|---|
| 6,141,989 | A * | 11/2000 | Oakey | F25J 3/04206 62/647 |
| 2016/0187059 | A1* | 6/2016 | Goloubev | F25J 3/04678 62/643 |
| 2017/0299261 | A1* | 10/2017 | Narinsky | F25J 3/0486 |
| 2018/0017322 | A1* | 1/2018 | Golubev | F25J 3/04412 |
| 2019/0242646 | A1* | 8/2019 | Golubev | F25J 3/04854 |
| 2020/0318898 | A1* | 10/2020 | Hirose | F25J 3/04284 |

FOREIGN PATENT DOCUMENTS

| | | | |
|---|---|---|---|
| EP | 1287302 | B1 | 9/2005 |
| EP | 2789958 | A1 | 10/2014 |
| EP | 3290843 | A2 | 3/2018 |
| EP | 3521739 | A1 | 8/2019 |
| EP | 3557166 | A1 | 10/2019 |
| WO | 2020187449 | A1 | 9/2020 |

* cited by examiner

PROCESS AND PLANT FOR LOW-TEMPERATURE SEPARATION OF AIR

The present invention relates to a process and to a plant for low-temperature air separation according to the preambles of the independent claims.

PRIOR ART

The production of air products in the liquid or gaseous state by cryogenic fractionation of air in air separation plants is known and described, for example, in H.-W. Häring (editor), Industrial Gases Processing, Wiley-VCH, 2006, in particular Section 2.2.5, "Cryogenic Rectification."

Air separation plants have rectification column systems that can be designed as two-column systems, in particular as double-column systems, but also as triple-column or multi-column systems. In addition to rectification columns for extracting nitrogen and/or oxygen in the liquid and/or gaseous state, i.e., rectification columns for nitrogen-oxygen separation, rectification columns for extracting further air components, in particular the noble gases krypton, xenon and/or argon, can be provided.

The rectification columns of the mentioned rectification column systems are operated at different pressure levels. Known double-column systems have a so-called high-pressure column (also referred to as a pressure column, medium-pressure column or lower column) and a so-called low-pressure column (also referred to as an upper column). The high-pressure column is typically operated at a pressure level of 4 to 7 bar, in particular approximately 5.3 bar. The low-pressure column is operated at a pressure level of typically 1 to 2 bar, in particular approximately 1.4 bar. In certain cases, even higher pressure levels may be used in either rectification column. The pressures cited here and below are absolute pressures at the top of the respective columns indicated.

Depending on the required product spectra (i.e., the quantities of different liquid and gaseous air products to be produced absolutely and relative to one another), different plant configurations of air separation plants are of different suitability. For example, if predominantly gaseous nitrogen at an elevated pressure level is required, a process described, for example, in EP 2 789 958 A1 and the further patent literature cited therein may be advantageous. This process can also be used with a so-called pure-oxygen column and/or combined with a (vacuum) pressure-swing adsorption. In this way, oxygen of different purity can also be provided. In certain cases, however, there is a need for further optimization.

For certain objects, air separation plants or corresponding processes are required, which in addition to relatively large quantities of nitrogen with comparatively high purity (about 80 ppb oxygen content and less) also provide certain quantities of an impure oxygen product. Corresponding nitrogen can be required, for example, in semiconductor or display manufacturing, whereas the impure oxygen is required for the glass production for corresponding displays on site. In particular, the provision of pure oxygen as an additional product can sometimes not take place in the desired efficiency by means of the air separation plants and processes known to date.

There is therefore the need for processes and plants for the low-temperature separation of air, which advantageously fulfill the aforementioned requirements.

DISCLOSURE OF THE INVENTION

This object is achieved by a process and a plant for low-temperature air separation with the respective features of the independent claims. Advantageous embodiments comprise the subject matter of the respective dependent claims as well as the following description.

In the following, some terms used in describing the present invention and its advantages, as well as the underlying technical background, will first be explained in more detail.

The devices used in an air separation plant are described in the cited technical literature, for example in Haring, Section 2.2.5.6, "Apparatus." Unless the following definitions differ, reference is therefore explicitly made to the cited technical literature with respect to terminology used within the framework of the present application.

A "condenser evaporator" refers to a heat exchanger in which a first, condensing fluid stream enters into indirect heat exchange with a second, evaporating fluid stream. Each condenser evaporator has a liquefaction chamber and an evaporation chamber. The liquefaction and evaporation chambers have liquefaction or evaporation passages. Condensation (liquefaction) of the first fluid stream is carried out in the liquefaction chamber, and evaporation of the second fluid stream in the evaporation chamber. The evaporation and liquefaction chambers are formed by groups of passages, which are in a heat-exchanging relationship with one another.

In particular, the so-called main condenser, which connects a high-pressure column and a low-pressure column of an air separation plant in a heat-exchanging manner, is designed as a condenser-evaporator. The main condenser can be designed in particular as a single-level or multi-level bath evaporator, in particular as a cascade evaporator (as described, for example, in EP 1 287 302 B1) but also as a falling-film evaporator. It can be formed by a single heat exchanger block or by a plurality of heat exchanger blocks arranged in a common pressure vessel.

In a "forced-flow" condenser-evaporator, which can also be used within the scope of the present invention, a liquid stream is pressed by means of its own pressure through the evaporation chamber and partially evaporated there. This pressure is generated for example by a liquid column in the feed line to the evaporation chamber. The height of this liquid column here corresponds to the pressure loss in the evaporation chamber. In a "once-through" condenser-evaporator of this type, the gas or gas-liquid mixture emerging from the evaporation chamber is conducted directly to the next process step or to a downstream device and in particular is not introduced into a liquid bath of the condenser-evaporator from which the portion remaining liquid would be drawn in again.

An "expansion turbine" or "expansion machine," which can be coupled via a common shaft to further expansion turbines or energy converters such as oil brakes, generators or compressors, is set up for relieving a gaseous or at least partially liquid stream. In particular, expansion turbines for use in the present invention can be designed as turbo-expanders. When a compressor is driven by one or more expansion turbines, but without any energy supplied externally, for example by means of an electric motor, the term "turbine-driven" compressor or alternatively "booster" is used. Arrangements of turbine-driven compressors and expansion turbines are also referred to as "booster turbines."

Multi-stage turbocompressors, referred to herein as "main air compressors," are used in air separation plants to compress the feed air that is to be separated. The mechanical construction of turbocompressors is generally known to the person skilled in the art. In a turbocompressor, the compression of the medium to be compressed takes place by means of turbine blades that are arranged on a turbine wheel or impeller or directly on a shaft. A turbocompressor forms a structural unit that, however, may have a plurality of compressor stages in a multi-stage turbocompressor. A compressor stage generally comprises a corresponding arrangement of turbine blades. All of these compressor stages may be driven by a common shaft. However, it may also be provided that the compressor stages are driven in groups with different shafts, wherein the shafts may also be connected to one another via gearing.

The main air compressor is further characterized in that the entire quantity of air supplied to the rectification column system and used for the production of air products, i.e., the entirety of the feed air, is compressed by said main air compressor. Accordingly, a "booster air compressor" may also be provided in which, however, only a portion of the air quantity compressed in the main air compressor is brought to an even higher pressure. This can also be designed as a turbocompressor. The use of a common compressor or of compressor stages of such a compressor as main air compressor and booster can also be provided. For compressing partial air quantities, further turbocompressors in the form of the aforesaid boosters are typically provided in air separation plants, which as a rule, in comparison to the main air compressor or the booster, however, effect only a compression to a relatively small extent.

Liquids and gases may, in the terminology used herein, be rich or low in one or more components, wherein "rich" can refer to a content of at least 50%, 75%, 90%, 95%, 99%, 99.5%, 99.9% or 99.99%, and "low" can refer to a content of at most 50%, 25%, 10%, 5%, 1%, 0.1% or 0.01% on a mole, weight or volume basis. The term "predominantly" can correspond to the definition of "rich." Liquids and gases may also be enriched in or depleted of one or more components, wherein these terms refer to a content in a starting liquid or a starting gas from which the liquid or gas has been extracted. The liquid or the gas is "enriched" if it contains at least 1.1 times, 1.5 times, 2 times, 5 times, 10 times, 100 times or 1,000 times the content, and "depleted" if it contains at most 0.9 times, 0.5 times, 0.1 times, 0.01 times or 0.001 times the content of a corresponding component, based on the starting liquid or the starting gas. If, by way of example, reference is made here to "oxygen" or "nitrogen," this is also understood to mean a liquid or a gas that is rich in oxygen or nitrogen but need not necessarily consist exclusively of it.

The present application uses the terms "pressure level" and "temperature level" to characterize pressures and temperatures, which means that corresponding pressures and temperatures in a corresponding plant do not have to be used in the form of exact pressure or temperature values in order to realize the inventive concept. However, such pressures and temperatures typically fall within certain ranges that are, for example, ±1%, 5% or 10% around an average. In this case, corresponding pressure levels and temperature levels can be in disjointed ranges or in ranges that overlap one another. In particular, pressure levels, for example, include unavoidable or expected pressure losses. The same applies to temperature levels. The pressure levels indicated here in bar are absolute pressures.

FEATURES AND ADVANTAGES OF THE INVENTION

In order to fulfill the product requirements mentioned at the outset, i.e., the provision of relatively large quantities of nitrogen with comparatively high purity and at elevated pressure and the simultaneous provision of certain quantities of an impure oxygen product, it is possible in principle to use a process described in EP 3 557 166 A1 with a so-called mixing column and a reinforcing circuit for the high-pressure column, wherein the double-column system is operated at elevated pressure.

Furthermore, EP 3 521 739 A1 discloses a process for extracting nitrogen, with which the low-pressure column of the double-column system used has a head condenser (also known as "double column, double condenser" or DCDC process). This process provides for the use of forced-flow condenser-evaporators and a residual gas turbine for the purpose of generating the process cooling capacity.

The process known from EP 3 521 739 A1 is very good for pure gas production with nitrogen product pressures of about 8 to 8.5 bar (or also for significantly higher pressures if product recompression is considered). For somewhat higher product pressures (e.g., 11 bar), this process remained very efficient until now only if a relatively large quantity of liquid (e.g., liquid nitrogen, LIN) is also produced in addition to gaseous nitrogen as the main product. This is attributable to the cooling capacity in this process being adjusted/varied by the pressure in the evaporation chamber of the condenser of the low-pressure column. If the necessary cooling capacity in the process is low (e.g., in the case of pure gas production), the pressure in the evaporation chamber or the pressure gradient at the residual gas turbine is also low. However, the low evaporation pressure also results in low operating pressures in both rectification columns and a relatively low (about 8 to 8.5 bar) nitrogen product pressure. On the other hand, if the necessary cooling capacity in the process is high (e.g., in the case of liquid production), the pressure in the evaporation chamber or the pressure gradient at the residual gas turbine is also high. The high evaporation pressure then leads to high operating pressures in both rectification columns and to a high nitrogen product pressure.

The present invention is based in principle on the knowledge that a process of the type just described can be expanded with an additional column, whereby the problems mentioned can be overcome. Within the scope of the present invention, a higher pressure can be used in the evaporation chamber of the head condenser of the low-pressure column, so that a corresponding increase in the nitrogen product pressure (e.g., up to the desired 11 bar) is possible but without having to increase the liquid output of the plant. According to the invention, only a portion of the residual gas from the evaporation chamber of the head condenser of the low-pressure column is decompressed to perform work. As a result, the cooling capacity remains relatively low. A further portion of the residual gas "drives" the rectification process in the additional rectification column. In the sump of this additional rectification column, impure oxygen is extracted, which is subsequently also extracted as an internally compressed stream. With respect to the term "internal compression," reference is made to the technical literature mentioned in the introduction.

The process proposed according to the invention has a significantly greater efficiency compared to the known processes explained further above.

Overall, the present invention proposes a process for the low-temperature separation of air, with which an air separation plant with a first rectification column and a second rectification column is used, wherein the first rectification column is operated at a pressure level of 9 to 13.5 bar, in particular about 11.3 bar, and the second rectification column is operated at a pressure level of 5.5 to 8.5 bar, in particular about 7.3 bar. The stated values are in particular pressure values at the head of the respective rectification columns. The first rectification column and the second rectification column can in particular be combined in the manner of a known double column.

The first rectification column is supplied with cooled compressed air and the second rectification column is supplied with liquid from the first rectification column or liquid formed herefrom. Of course, this does not exclude that further feed streams can also be supplied to the first and second rectification columns and represents only a minimum requirement for the realization of the present invention.

If it is stated above and below that liquid from a rectification column or "liquid formed herefrom" is used in a particular way, the "liquid formed herefrom" is intended to mean, in particular, liquid for the formation of which the liquid used directly from the corresponding rectification column is used, and that this liquid is changed in its composition without complete evaporation but optionally by evaporation of a portion of its components. Cooling, heating, pressurization and decompression may also be provided.

By means of a first condenser-evaporator, which in particular can be the main condenser connecting the first and the second rectification column in a heat-exchanging manner and can be designed as a forced-flow condenser-evaporator, head gas of the first rectification column is condensed and liquid from the second rectification column or liquid formed herefrom (see above) is evaporated within the scope of the present invention, thereby producing a gas phase, which is here referred to as first evaporation product merely for later reference. The latter liquid is in particular sump liquid from the second rectification column or liquid formed from corresponding sump liquid.

On the other hand, by means of a second condenser-evaporator, which can likewise be designed as a forced-flow condenser-evaporator, head gas of the second rectification column is condensed and further liquid from the second rectification column or liquid formed herefrom is evaporated, thereby producing a second evaporation product. This further liquid can also in particular be sump liquid from the second rectification column or liquid formed from such sump liquid.

Within the scope of the present invention, a first portion of the second evaporation product is decompressed, heated and removed from the process by means of a decompression machine. This first portion, so-called impure nitrogen, can, for example, be discharged directly to the atmosphere or, as needed, be used beforehand for the regeneration of adsorber units for air purification. As mentioned, this portion, and thus the cooling capacity achieved, is lower than in conventional processes.

Within the scope of the present invention, head gas of the first rectification column is removed from the process as a pure nitrogen product. By operating the first rectification column at the mentioned, comparatively high pressure level, this pure nitrogen product can be provided at a corresponding pressure level to a consumer.

As already mentioned and again repeated here only in other words, a third rectification column is used within the scope of the present invention. This third rectification column is operated at a pressure level of 1.1 to 2.5 bar, in particular about 1.4 bar, in particular at the head of the third rectification column.

Furthermore, within the scope of the present invention, as mentioned, a rectification in the third rectification column is driven using further residual gas. This is achieved by means of a third condenser-evaporator that condenses a second portion of the second evaporation product and evaporates sump liquid of the third rectification column or liquid formed herefrom, thereby producing a third evaporation product. At least some of the second portion of the second evaporation product condensed by means of the third condenser-evaporator is then supplied to the third rectification column. Furthermore, the third rectification column is supplied with non-evaporated further liquid from the second rectification column or liquid formed herefrom, and further sump liquid of the third rectification column or liquid formed herefrom is internally compressed and removed from the process as the impure oxygen product mentioned.

The further sump liquid of the third rectification column, and thus the impure oxygen product, is formed in particular with an oxygen content of 85 to 99.8%, for example of 90 to 99.8%, for example with an oxygen content of 96.8%. This is therefore not necessarily a product, typically referred to as an impure oxygen, with up to 98% oxygen. Within the scope of the present invention, the pure nitrogen product can be provided in particular with a residual content of 10 ppm of oxygen or less, in particular 5 ppm of oxygen or less. The production quantity (i.e., the quantity of product removed in each case) for the impure oxygen product can, for example, be 5 to 10%, in particular about 8.7%, based on the pure nitrogen product. In an embodiment explained below, this quantity can also be up to 25%. Liquid nitrogen can likewise be removed, but a liquid nitrogen product quantity typically amounts to less than 1%, in particular less than 0.5%, for example about 0.1%, of the quantity of the pure nitrogen product. Further air products are typically not formed or not in a larger quantity than the aforementioned air products.

Within the scope of the present invention, the second condenser-evaporator is operated at an evaporation pressure level of 2 to 5 bar, in particular about 3.6 bar. This evaporation pressure level is, as mentioned, coupled to a certain extent with the rectification pressure levels in the first and second rectification columns. The first portion of the second evaporation product, which is decompressed by means of a decompression machine, heated and removed from the process, is supplied within the scope of the present invention to the decompression machine in particular at the evaporation pressure level.

Within the framework of a particularly preferred embodiment of the present invention, the first condenser-evaporator can partially evaporate sump liquid from the second rectification column, thereby producing the first evaporation product and a non-evaporated residue. A first portion of the non-evaporated residue can be evaporated by means of the second condenser-evaporator, thereby producing the second evaporation product. In this way, it is possible in particular to change the composition by achieving depletion of low-boiling substances (or enrichment of high-boiling substances) in the first condenser-evaporator. On the other hand, if, as in the second condenser-evaporator, complete evaporation takes place, no change in the composition results, since a corresponding depletion or enrichment effect does not occur.

In the embodiment of the present invention just explained, a second portion of the non-evaporated residue can be supplied to the third rectification column. In any case, the non-evaporated further liquid from the second rectification column or the liquid formed herefrom, which is supplied to the third rectification column, and the second portion of the second evaporation product that is condensed by means of the third condenser-evaporator, or the portion thereof, which is supplied to the third rectification column, can both be supplied to the third rectification column in a head region, wherein a "head region" is understood to mean a region above which no further separation devices are present.

In another embodiment, liquid that is removed via a side draw from the second rectification column and thus with a lower oxygen content than the sump liquid can be used as the non-evaporated further liquid from the second rectification column or the liquid formed herefrom, which is supplied to the third rectification column. In this embodiment, the third rectification column can, in particular, have a first separation section and a second separation section arranged above the first separation section, wherein the non-evaporated further liquid from the second rectification column or the liquid formed herefrom, which is supplied to the third rectification column, is supplied to the third rectification column above the second separation section, and wherein the second portion of the second evaporation product condensed by means of the third condenser-evaporator, or the portion thereof, which is supplied to the third rectification column, is supplied to the third rectification column between the first separation section and the second separation section.

In one embodiment of the present invention, the cooled compressed air, which is supplied to the first rectification column, can be exclusively gaseous, cooled or partially pre-liquefied compressed air that has been compressed to no longer the pressure level at which the first rectification column is operated.

In another embodiment, the cooled compressed air, which is supplied to the first rectification column, comprises gaseous, cooled compressed air that has been compressed to no longer the pressure level at which the first rectification column is operated, and further liquefied air that has been compressed to a pressure level above the pressure level at which the first rectification column is operated and which is subsequently liquefied and decompressed into the first rectification column. In this embodiment, the aforementioned product quantities of impure oxygen of up to 25%, for example about 20%, of the product quantities of pure nitrogen can also be produced. For further compression of the air to be liquefied, a separate air recompressor can in particular be used.

In the process according to the invention, the third rectification column can have 15 to 25, in particular 20, theoretical separating plates. The first rectification column can have 50 to 70, in particular 60, and the second rectification column can have 40 to 60, in particular 50, theoretical separating plates.

Regarding the features of the air separation plant likewise proposed according to the invention, reference is made expressly to the corresponding independent claim. This air separation plant is in particular configured to carry out a process as previously explained in embodiments. Reference is therefore expressly made to the above explanations regarding the process according to the invention and its advantageous embodiments.

The invention will be described in more detail below with reference to the accompanying drawings, which illustrate preferred embodiments of the present invention.

BRIEF DESCRIPTION OF THE DRAWINGS

FIGS. 1 to 5 show an air separation plant according to embodiments of the invention in a simplified schematic representation.

In the figures, identical or identically acting elements are in each case designated by identical reference signs and are not explained repeatedly for the sake of clarity. Plant components can in each case also represent corresponding process steps so that the following explanations regarding the air separation plants also relate to corresponding processes. In the figures, liquid material streams are indicated by black (filled) flow arrows, whereas gaseous streams of material are indicated by white (not filled) flow arrows.

DETAILED DESCRIPTION OF THE DRAWINGS

Figure 1:
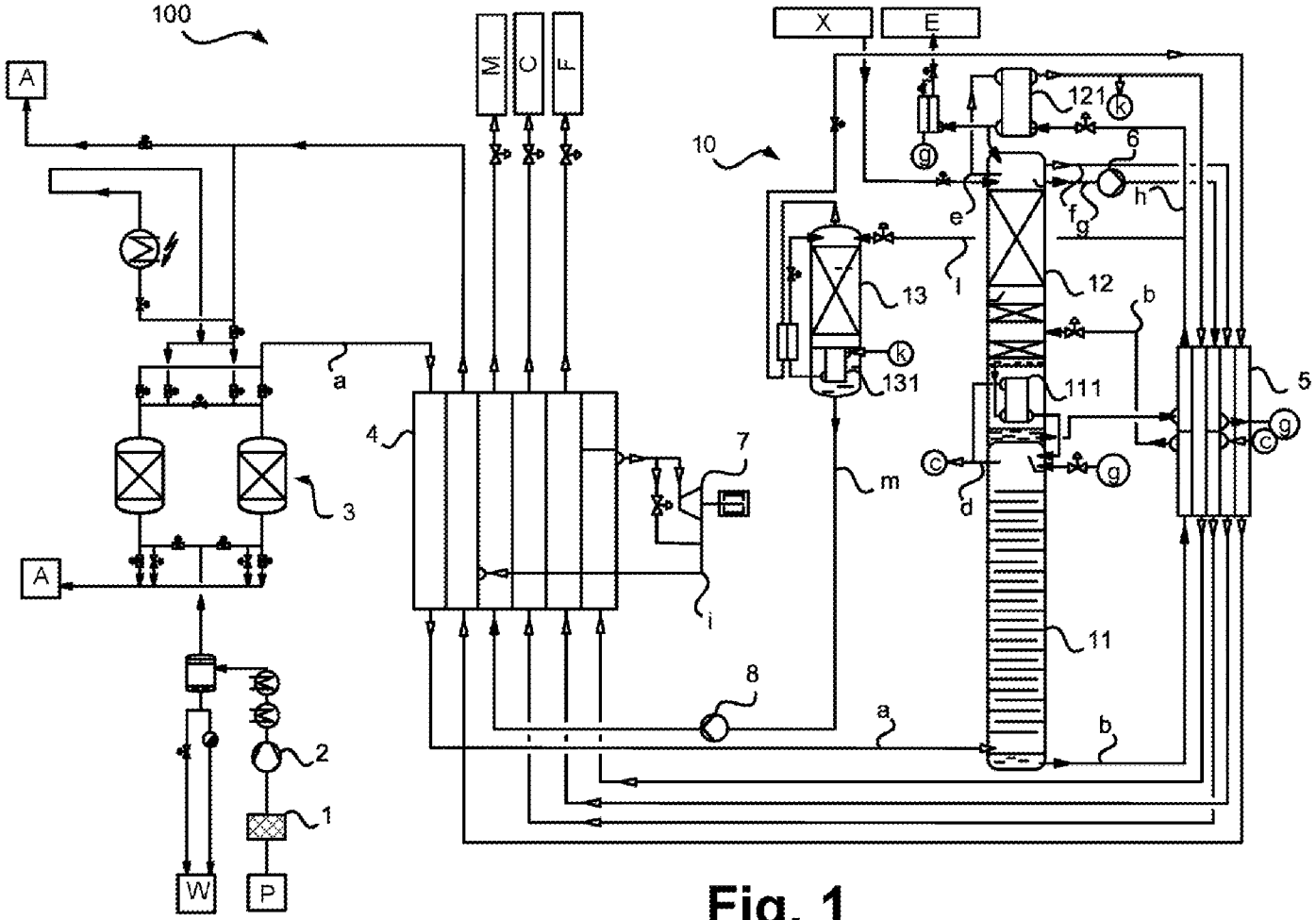

In FIG. 1, an air separation plant according to an embodiment of the invention is shown in the form of a schematic process flow diagram and is designated as a whole by 100.

In the plant 100, feed air or process air P is drawn in via a filter 1 by means of a main air compressor 2. After precooling in heat exchangers (not designated) and in a direct-contact cooler, which is operated with water W, the correspondingly compressed air is supplied to an adsorber station 3, where it is freed from unwanted components, such as water and carbon dioxide. The air is then fed in the form of a feed-air stream a to a main heat exchanger 4 of the air separation plant 100 and is extracted therefrom at the cold end. The feed air stream further on designated by a is supplied to a first rectification column (high-pressure column) 11 of a distillation column system 10 that, in addition to the first rectification column 11, also has a second rectification column (low-pressure column) 12 formed as a double column with the first rectification column 11 and a third rectification column 13.

In the first rectification column 11, a head gas and a sump liquid are formed, wherein the sump liquid from the first rectification column 11 is conducted here completely in the form of a material stream b through a supercooling counterflow heat exchanger 5 and is supplied to the second rectification column 12. A head gas and a sump liquid are formed in the second rectification column 12.

A portion of the head gas of the first rectification column 11 is condensed by means of a first condenser-evaporator 111 (main condenser), which is formed here as a forced-flow condenser-evaporator. A further portion of the head gas is drawn off in the form of a material stream c, conducted through the supercooling counterflow heat exchanger 5 and the main heat exchanger 4, and discharged as a pure nitrogen product C. The condensed portion of the head gas of the first rectification column 11 is recycled in the form of a material stream d into the first rectification column 11.

By means of the first condenser-evaporator 111, a portion of the sump liquid of the second rectification column 12 is also evaporated. The evaporated portion rises in the second rectification column 12.

Head gas of the second rectification column 12, which is supplied in the form of a material stream e to the second condenser-evaporator 121, is condensed by means of a second condenser-evaporator 121. The condensed head gas is partly recycled to the second rectification column 12 and is partly provided as a liquid nitrogen product E. Further head gas of the second rectification column 12 can be withdrawn therefrom in the form of a material stream f, conducted through the supercooling counterflow heat exchanger 5 and the main heat exchanger 4 and provided as a further compressed nitrogen product F.

Liquid collected at the head of the second rectification column 12 in a liquid retention device can be recycled in the form of a material stream g by means of a pump 6 through the supercooling counterflow heat exchanger 5 and to the first rectification column 11 ("back pumping"). At this point, a partial stream of the material stream used to form the liquid nitrogen product E can also be supplied, which is decompressed for the supercooling of the liquid nitrogen product E.

By means of a second condenser-evaporator 121, further sump liquid from the second rectification column 12 is evaporated and supplied in the form of a material stream h to the second condenser-evaporator 121 after it has previously been conducted through the supercooling counterflow heat exchanger 5.

By means of a decompression machine 7, which can be coupled to a simple brake or a generator, a first portion of the further sump liquid from the second rectification column 12 evaporated by means of the second condenser-evaporator 121 is decompressed in the form of a material stream i, is heated, before and after the decompression, in the supercooling counterflow heat exchanger 5 and in the main heat exchanger 4, and is removed from the process, i.e., discharged to the atmosphere A and, as needed, used as a regeneration gas in the adsorber station 3.

By means of a third condenser-evaporator 131, which is formed as a sump evaporator of the third rectification column 13, a second portion of the further sump liquid from the second rectification column 12 evaporated by means of the second condenser-evaporator 121 is condensed in the form of a material stream k. In the third condenser-evaporator 131, sump liquid of the third rectification column 13 is also evaporated.

At least some of the second portion, condensed by means of the third condenser-evaporator 131, of the further liquid from the second rectification column 12 evaporated by means of the second condenser-evaporator 121 is supplied to the third rectification column 13. The third rectification column 13 is further supplied in the form of a material stream I with non-evaporated further liquid from the second rectification column 12. Sump liquid of the third rectification column 13 is internally compressed in the form of a material stream m by means of a pump 8 and removed from the process as an internally compressed oxygen product M.

In the air separation plant 100 according to FIG. 1, the non-evaporated further liquid from the second rectification column 12, which is supplied in the form of the material stream I to the third rectification column, is sump liquid of the second rectification column 12. The latter is also supplied to the third rectification column 13 in a head region, like the second portion, condensed by means of the third condenser-evaporator 131, of the further liquid from the second rectification column 12 evaporated by means of the second condenser-evaporator 121, or the portion thereof, which is supplied to the third rectification column 13. An additional supply of liquid nitrogen X is likewise illustrated.

Figure 2:
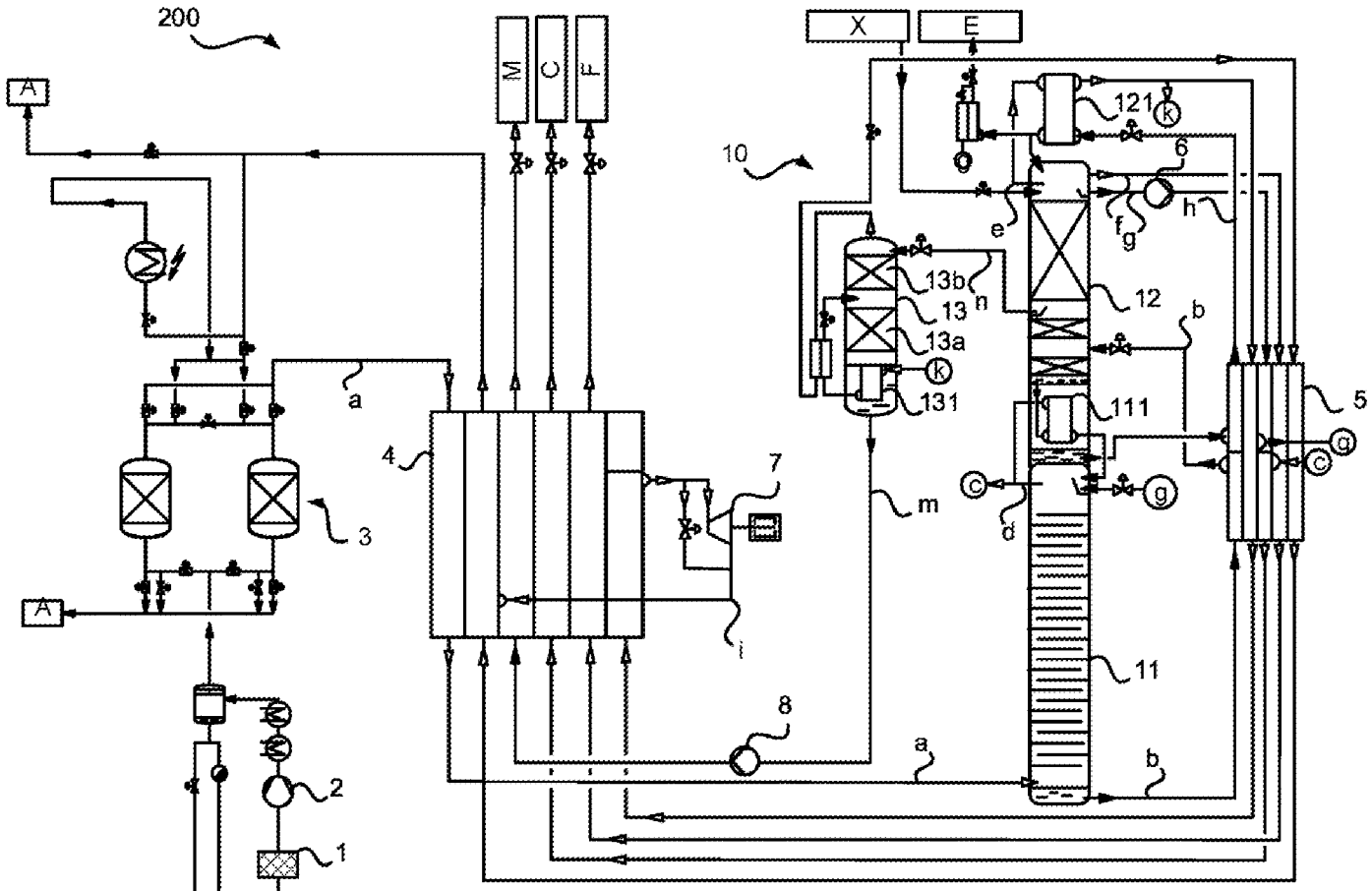

In the air separation plant 200 according to FIG. 2, which illustrates a further embodiment of the present invention, this supply takes place differently. Liquid of a material stream n, which is withdrawn from the second rectification column 12 via a side draw, is used here as a non-evaporated further liquid from the second rectification column 12, which is supplied to the third rectification column 13.

In the air separation plant 200 according to FIG. 2, the third rectification column 13 has a first separation section 13*a* and a second separation section 13*b* arranged above the first separation section 13*a*, wherein the non-evaporated further liquid from the second rectification column 12, which is supplied to the third rectification column 13, i.e., the material stream n, is supplied to the third rectification column 13 above the second separation section 13*b*, and wherein the second portion, condensed by means of the second condenser-evaporator 131, of the further liquid from the second rectification column 12 evaporated by means of the second condenser-evaporator 121, or the portion thereof, which is supplied to the third rectification column 13, i.e., the material stream k, is supplied to the third rectification column 13 between the first separation section 13*a* and the second separation section 13*b*.

In the air separation plants 100 and 200 according to FIGS. 1 and 2, the cooled compressed air that is supplied to the first rectification column 11 is exclusively gaseous, cooled or pre-liquefied compressed air that has been compressed in the main air compressor 2 to no longer the pressure level at which the first rectification column 11 is operated.

Figure 3:
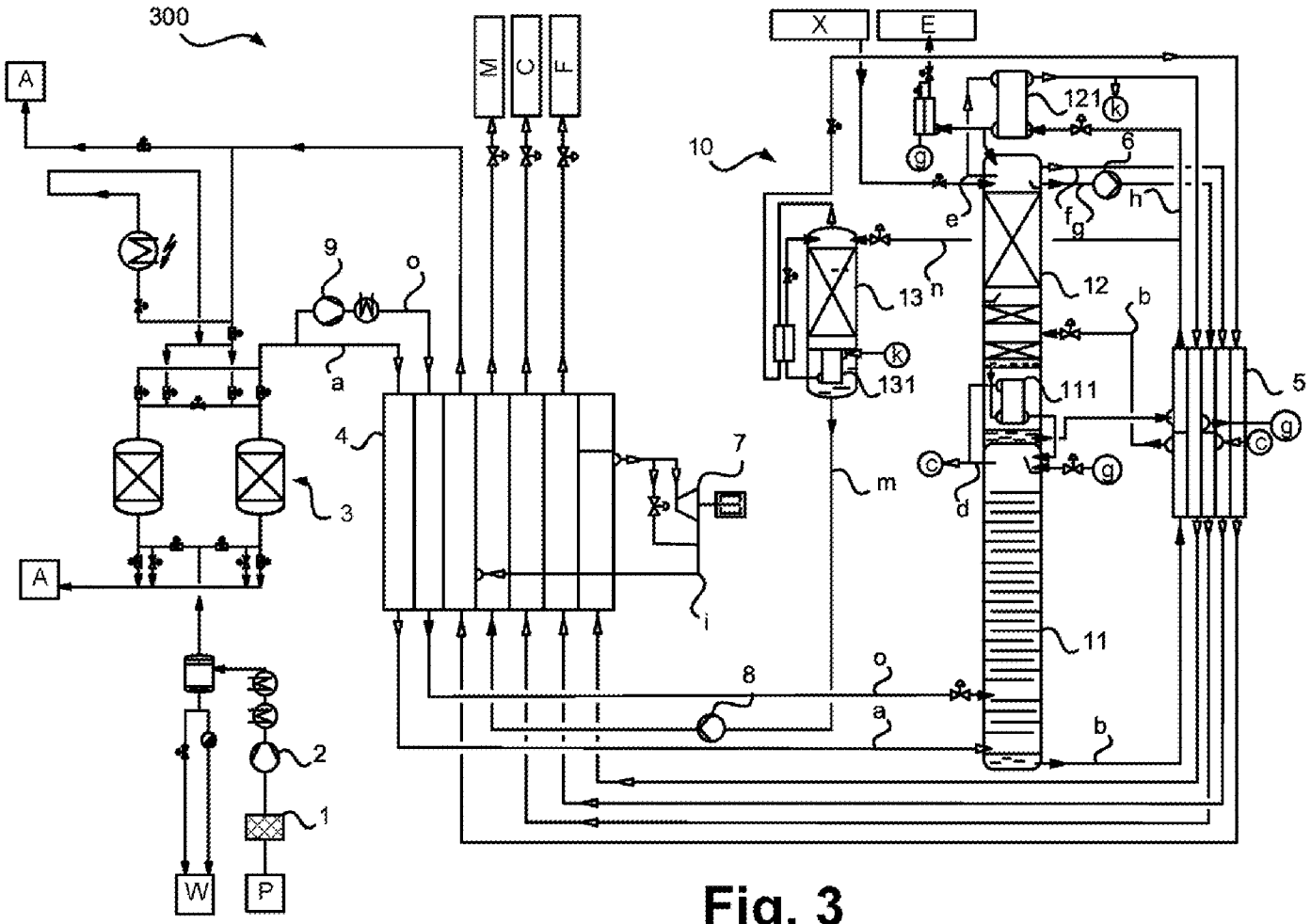

In the air separation plant 300 according to FIG. 3, which illustrates a further embodiment of the present invention, this air supply takes place differently. The cooled compressed air that is supplied to the first rectification column 11 comprises here the gaseous, cooled compressed air of material stream a, which has been compressed to no longer the pressure level at which the first rectification column 11 is operated, but additionally also liquefied air of a material stream o, which has been compressed by means of a recompressor 9 to a pressure level above the pressure level at which the first rectification column 11 is operated, and which is subsequently liquefied in the main heat exchanger 4 and decompressed into the first rectification column 11.

Figure 4:
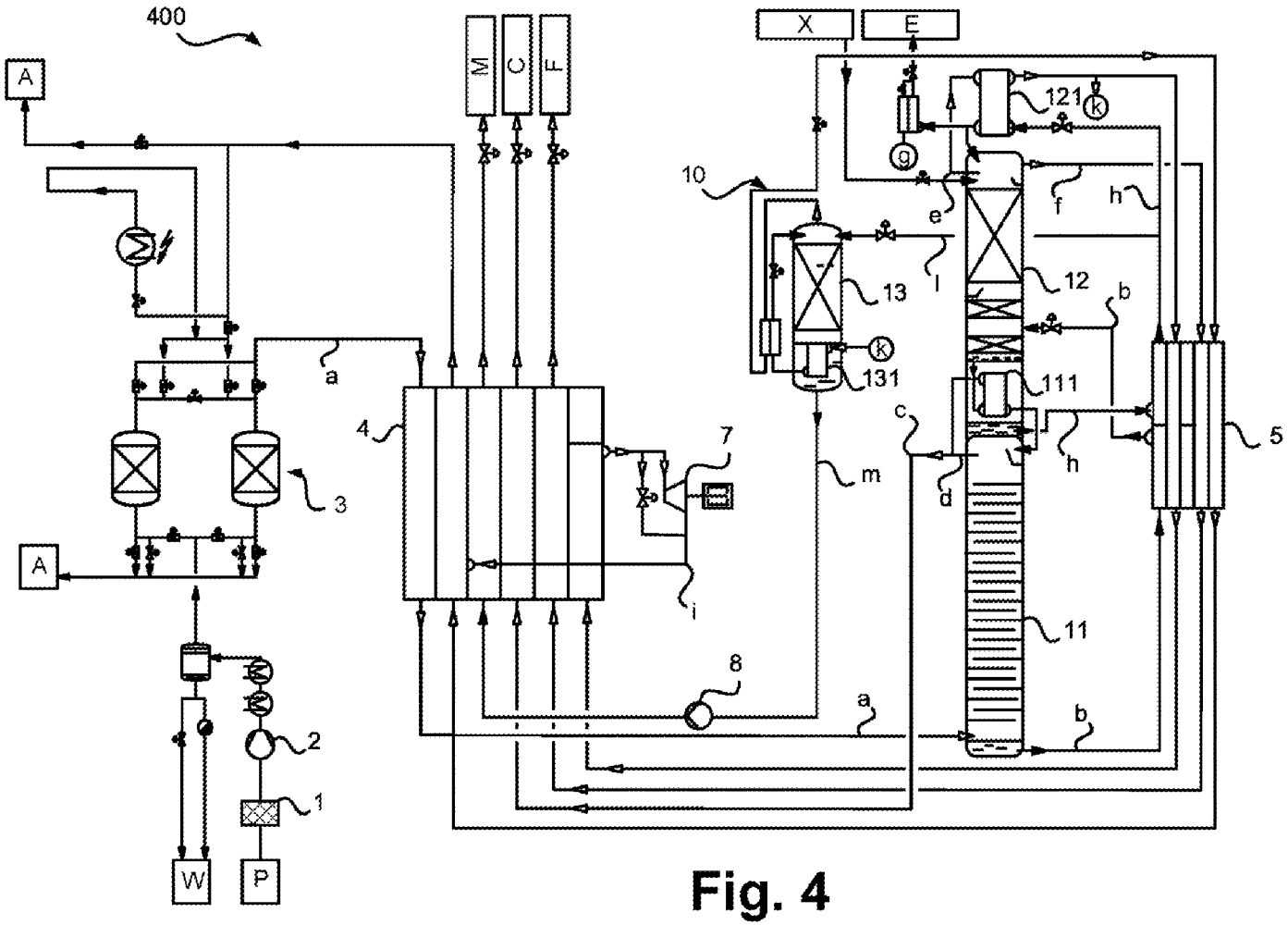

In contrast to the air separation plants illustrated above, in the air separation plant 400 according to FIG. 4, which illustrates a further embodiment of the present invention, no liquid collected at the head of the second rectification column 12 in a liquid retention device is recycled to the first rectification column 11. The partial stream of the material stream used to form the liquid nitrogen product E, which is decompressed for supercooling the liquid nitrogen product E, can nevertheless be supplied to the first rectification column 11 (not shown).

The material stream c is heated here without being conducted beforehand through the supercooling counterflow heat exchanger 5. Therefore, the supercooling counterflow heat exchanger 5 typically does not have a corresponding passage. The passage for the liquid, which is collected according to the plants illustrated above at the head of the second rectification column 12 in a liquid retention device and recycled to the first rectification column 11, is also typically omitted, even if both passages are still rudimentarily illustrated in FIG. 4.

The invention claimed is:

1. A process for the low-temperature separation of air using an air separation plant having a first rectification column and a second rectification column, said process comprising:

operating the first rectification column at a pressure level of 9 to 13.5 bar and operating the second rectification column at a pressure level of 5.5 to 8.5 bar, supplying the first rectification column with cooled compressed air and supplying the second rectification column with liquid from the first rectification column or liquid formed herefrom, condensing a first portion of head gas from the first rectification column in a first condenser-evaporator and evaporating liquid from the second rectification column or liquid formed herefrom in the first condenser-evaporator to produce a first evaporation product, condensing head gas from the second rectification column in a second condenser-evaporator and evaporating further liquid from the second rectification column or liquid formed herefrom in the second condenser-evaporator to produce a second evaporation product, decompressing and heating a first portion of the second evaporation product, and removing resultant decompressed, heated first portion of the second evaporation product from the process, and removing a second portion of the head gas from the first rectification column from the process as a pure nitrogen product, wherein a third rectification column, operated at a pressure level of 1.1 to 2.5 bar, is also used in the process, and said process further comprises:

condensing in a third condenser-evaporator a second portion of the second evaporation product and evaporating sump liquid from the third rectification column or liquid formed herefrom in the third condenser-evaporator to produce a third evaporation product, supplying at least part of the second portion of the second evaporation product condensed in the third condenser-evaporator to the third rectification column, supplying the third rectification column with non-evaporated further liquid from the second rectification column or liquid formed herefrom, and internally compressing and removing from the process further sump liquid from the third rectification column or liquid formed herefrom as an impure oxygen product.

2. The process according to claim 1, wherein the further sump liquid from the third rectification column has an oxygen content of 85 to 99.8%.

3. The process according to claim 1, wherein at least the second condenser-evaporator is a forced-flow condenser-evaporator.

4. The process according to claim 1, wherein the second condenser-evaporator is operated at an evaporation pressure level of 2 to 5 bar.

5. The process according to claim 4, wherein the first portion of the second evaporation product, which is decompressed by a decompression machine, heated and removed from the process, is supplied to the decompression machine at evaporation pressure level.

6. The process according to claim 1, wherein the liquid from the second rectification column is sump liquid from the second rectification column, and the sump liquid from the second rectification column is evaporated in the first condenser-evaporator to produce the first evaporation product and a non-evaporated residue, and a first portion of the non-evaporated residue is the further liquid from the second rectification column evaporated in the second condenser-evaporator to produce the second evaporation product.

7. The process according to claim 6, wherein the non-evaporated further liquid from the second rectification column supplied to the third rectification column is a second portion of the non-evaporated residue produced in the first condenser-evaporator.

8. The process according to claim 7, wherein (a) the non-evaporated, further liquid from the second rectification column, or the liquid formed herefrom, which is supplied to the third rectification column, and (b) the second portion of the second evaporation product condensed in the third condenser-evaporator, or the portion thereof, which is supplied to the third rectification column, are both supplied to the third rectification column in a head region.

9. The process according to claim 1, further comprising withdrawing liquid from the second rectification column via a side draw and using the withdrawn liquid as the non-evaporated further liquid from the second rectification column or the liquid formed herefrom, which is supplied to the third rectification column.

10. The process according to claim 9, wherein the third rectification column has a first separation section and a second separation section arranged above the first separation section, wherein the non-evaporated further liquid from the second rectification column or the liquid formed herefrom, which is supplied to the third rectification column, is supplied to the third rectification column above the second separation section, and the second portion of the second evaporation product condensed by in the third condenser-evaporator, or the portion thereof, which is supplied to the third rectification column, is supplied to the third rectification column between the first separation section and the second separation section.

11. The process according to claim 1, further comprising liquefying an air stream that has been compressed to a pressure level above a pressure level at which the first rectification column is operated to produce a liquified compressed air stream, decompressing the liquified compressed air stream into the first rectification column.

12. The process according to claim 1, wherein the third rectification column has 10 to 45 theoretical separating plates.

13. An air separation plant comprising:

a first rectification column and a second rectification column wherein the first rectification column is configured to operate at a pressure level of 9 to 13.5 bar and the second rectification column is configured to operate at a pressure level of 5.5 to 8.5 bar, a first line to supply the first rectification column with cooled compressed air and a second line to supply the second rectification column with liquid from the first rectification column or liquid formed herefrom, a first condenser-evaporator for condensing a first portion of head gas from the first rectification column and for evaporating liquid from the second rectification column or liquid formed herefrom, wherein the first condenser-evaporator produces a first evaporation product, a second condenser-evaporator for condensing head gas from the second rectification column and for evaporating further liquid from the second rectification column or liquid formed herefrom, wherein the second condenser-evaporator produces a second evaporation product, an expansion turbine for decompressing a first portion of the second evaporation product, means for heating the first portion of the second evaporation product, and means for removing from the process the first portion of the second evaporation product, and means for removing a second portion of the head gas of the first rectification column from the process as a pure nitrogen product, a third rectification column which is configured to operate at a pressure level of 1.1 to 2.5 bar, a third condenser-evaporator for condensing a second portion of the second evaporation product and for evaporating liquid from the third rectification column or liquid formed herefrom, wherein the second condenser-evaporator produces a third evaporation product, means to supply at least some of the second portion of the second evaporation product condensed in the third condenser-evaporator to the third rectification column, means to supply the third rectification column with non-evaporated further liquid from the second rectification column or liquid formed herefrom, and means to internally compress sump liquid of the third rectification column or liquid formed herefrom and means to remove the internally compressed sump liquid of the third rectification column or liquid formed herefrom from the process as an impure oxygen product.

14. The process according to claim 1, wherein the first rectification column has 50 to 70 theoretical separating plates.

15. The process according to claim 1, wherein the second rectification column has 40 to 60 theoretical separating plates.

16. The process according to claim 1, wherein the first rectification column has 50 to 70 theoretical separating plates, the second rectification column has 40 to 60 theoretical separating plates, and the third rectification column has 10 to 45 theoretical separating plates.

17. The process according to claim 1, wherein the non-evaporated further liquid from the second rectification column that is supplied to the third rectification column is sump liquid from the second rectification column.

18. The process according to claim 1, wherein the non-evaporated further liquid from the second rectification column that is supplied to the third rectification column is supplied to a head region of the third rectification column.

19. The process according to claim 1, wherein the second portion of the second evaporation product condensed in the third condenser-evaporator is supplied to a head region of the third rectification column.

* * * * *